US005846083A

United States Patent [19]

Alexander

[11] Patent Number: 5,846,083

[45] Date of Patent: Dec. 8, 1998

[54] LEAD DEMONSTRATOR

[76] Inventor: John E. Alexander, 17 Spring Wish La., Flint Hill, Va. 22627

[21] Appl. No.: 858,627

[22] Filed: May 19, 1997

Related U.S. Application Data

[63] Continuation-in-part of Ser. No. 588,098, Jan. 18, 1996, abandoned, which is a continuation of Ser. No. 528,350, Sep. 14, 1995, abandoned.

[51] Int. Cl.[6] ..... F41G 3/26

[52] U.S. Cl. ..... 434/19; 273/348

[58] Field of Search ..... 273/348; 434/19; 33/233

[56] References Cited

U.S. PATENT DOCUMENTS

| | | | |
|---|---|---|---|
| 752,962 | 2/1904 | Eby | 33/233 |
| 1,476,884 | 12/1923 | Gregory | 33/233 |
| 2,510,413 | 6/1950 | Paige | 434/19 |

*Primary Examiner*—Mark S. Graham
*Attorney, Agent, or Firm*—Lagerman & Associates, P.C.

[57] ABSTRACT

Target and shooting aid having a silhouette of a target connected to a flexible connector. The flexible connector is coupled to an attaching device for attaching the connector to the barrel of a gun. The target silhouette is sized such that it visually corresponds to an image of an actual target that a shooter would view down range. The target image may be selectively manipulated with the line of sight of a shooter.

5 Claims, 4 Drawing Sheets

LEAD DEMONSTRATOR

This is a continuation-in-part of U.S. patent application Ser. No.08/588,098 filed Jan. 18, 1996, abandoned, which is a continuation-in-part of U.S. patent application Ser. No. 08/528,350 filed Sep. 14, 1995, abandoned, and is entitled to the benefits of 35 U.S.C. § 120 for priority based thereof.

BACKGROUND OF THE INVENTION

1. Field of the Invention

The present invention generally relates to target and shooting aids, and, more particularly, to a device that facilitates the visualization of lead and target alignment as it relates to shooting stationary or non-stationary targets.

2. Description of the Related Art

Target shooting as a sport has enjoyed steady gains in popularity throughout the years for men and women, young and old alike. Obviously the more successful a person is at hitting the targets, the more likely they are to continue investing and promoting the sport.

There are a number of shooting aids that enhance the likelihood of hitting the target on a regular basis. With rifle and or pistol shooting this is accomplished by using aiming devices.

One type of aiming device is the sights that are attached to the front and back of the barrel; these sights are precision machined and permanently attached to the barrel. By incrementally changing either the front or back sights the point of impact of the bullet is changed to accomplish hitting the target. There are several different types of sights including the shallow-V, peep or aperture sight, and the partridge sight.

The other commonly used aiming device is a scope, also mounted on the gun barrel. A scope magnifies distant targets using a series of lenses. Inside the scope are reticles, commonly referred to as cross-hairs. By adjusting the cross-hairs up, down, right, or left, the point of impact of the bullet can be more accurately determined than by mere use of the gun mounted sights.

When teaching students rifle and pistol instructors generally explain the concept of aiming to a student, including determining the proper alignment of the gun sights with the stationary target. By looking at the results of several firings, the instructor adjusts the student's accuracy by helping to perfect their down range target visualization. This is usually accomplished by trial and error with the instructor seeking verbal feedback from the student as to how he or she aligned the target prior to shooting, followed by a review of the impact location to determine the proper corrective action.

This method, however, has several drawbacks. First, the student does not have a clear picture at the outset as to what proper alignment looks like down range. Only after repeated firings and much experience does their target visualization gradually improve. Another drawback is that the instructor must rely on the students interpretation of what was seen down range prior to shooting, which may or may not be accurate.

The target visualization problem is magnified when shooting at non-stationary targets. While rifle and pistol shooting is predominantly at stationary targets, shotgun shooting is at flying or moving targets.

The sport of shotgun shooting encompasses hunting, trap, skeet, and sporting clays. Trap shooting consists of five shots from each of five stations. Targets are launched from a single thrower at the front of the field and travel away from the shooter at each of three varying angles.

Skeet is shot from eight stations arranged in a semi-circle. Targets are launched from two different throwers at the sides of the field—a three and a half foot "low house" and a ten foot "high house." The target travel path is consistent but each station on the semi-circle requires a different lead.

Lead is how far in front of a moving target you must aim and shoot to hit it. While the concept of lead is simple, teaching the student to visualize the proper lead is not an easy task. In addition, the amount of lead changes depending on the angle and height of the moving target and the location of the shooter. Moreover, unlike stationary target shooting where time is not necessarily a factor, when shooting moving targets the student has approximately 2.5 seconds to find the target in the sky, coordinate the movement of the barrel to the speed of the target, determine the proper lead, fire and follow through. More advanced target presentations such as sporting clays and hunting allow less time to determine lead.

For a shooter who is strong enough to hold an 8 or 9 pound shotgun on their shoulder and perform this process, a great deal of practice must be undertaken before the concept of target lead is understood. The problem is compounded as the shooter's physical ability decreases. Limited upper body strength inhibits the ability to mount, swing, and visually acquire the proper lead.

Whether shooting moving or stationary targets, the fundamental problem is the same; there is no common visual baseline by which the instructor and shooter may reference during the course of instruction. The verbal exchange between the instructor and student is helpful but it still lacks the precision needed to ensure consistently accurate shooting.

In light of the foregoing, there exists a need for a device to provide an accurate visualization baseline of target alignment and lead when firing at stationary and moving targets.

SUMMARY OF THE INVENTION

The present invention is directed to a target and shooting aid, which substantially obviates one or more of the problems due to the limitations and disadvantages of the related art.

The invention provides for a shooting aid device that may be placed on or in the end of a gun barrel to enable the shooter to more accurately visualize the down range alignment of a target for shooting at moving or stationary targets. The shooting aid consists of a target silhouette that is sized such that the shooter views what would be seen down the sights of a gun barrel. The target silhouette is attached to a flexible connecting means that can be manipulated to selectively position the target silhouette in the field of view of the shooter to approximate the down range target image.

To achieve these and other advantages and in accordance with the purpose of the invention, as embodied and broadly described, the invention provides for a target and shooting aid, comprising a target representation means; connecting means having first and second ends, said first end being coupled to said target means; and attaching means, coupled to said second end of said connecting means, said attaching means being adaptable to attach to a gun barrel.

One embodiment of the preferred invention provides a target and shooting aid, comprising a connecting means having a first and second ends, said first end being adapted to be reversibly coupled to a target representation means; and attaching means, coupled to said second end of said connecting means, said attaching means being adapted for reversible attachment to an external surface of a dischargeable weapon, or simulated weapon, wherein said attaching means does not wrap entirely around the barrel of said dischargeable weapon, or simulated weapon, wherein said aid is adapted to permit movement of said target representation means in three planes.

Another embodiment of the invention provides a target and shooting aid, comprising a connecting means having a first and second ends, wherein said first end may be reversibly coupled to a target representation means, and wherein at least a portion of said connecting means is flexible such that it can be reversibly shaped to permit movement of said target means in three planes; and attaching means, coupled to said second end of said connecting means, said attaching means being adapted for reversible attachment to an external surface of a dischargeable weapon, or simulated weapon, or to an internal surface of the barrel of a dischargeable weapon, or simulated weapons.

A further embodiment of the invention provides a target and shooting aid, comprising a connecting means having a first and second ends, said first end being adapted for reversibly coupling with a target representation means, wherein said target representation means may be movable in three planes by adjustment of one or more portions of said connecting means, and wherein at least a portion of said connecting means is comprised of a bar, which is part of said adjustment means and is adapted to permit movement of a target representation means in at least one of said three planes; and attaching means, coupled to said second end of said connecting means said, attaching means being adaptable for reversible attachment to an external surface of a dischargeable weapon, or simulated weapon, or to an internal surface of the barrel of a dischargeable weapon, or a simulated weapon.

It is to be understood that both the foregoing general description and the following detailed description are exemplary and explanatory and are intended to provide further explanation of the invention as claimed.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1B:
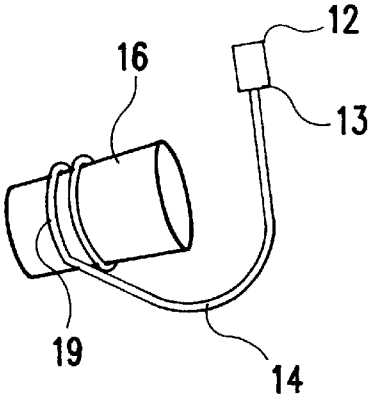
FIG. 1B is a perspective view of the embodiment of FIG. 1A with an alternate connection point embodiment.
Figure 1A:
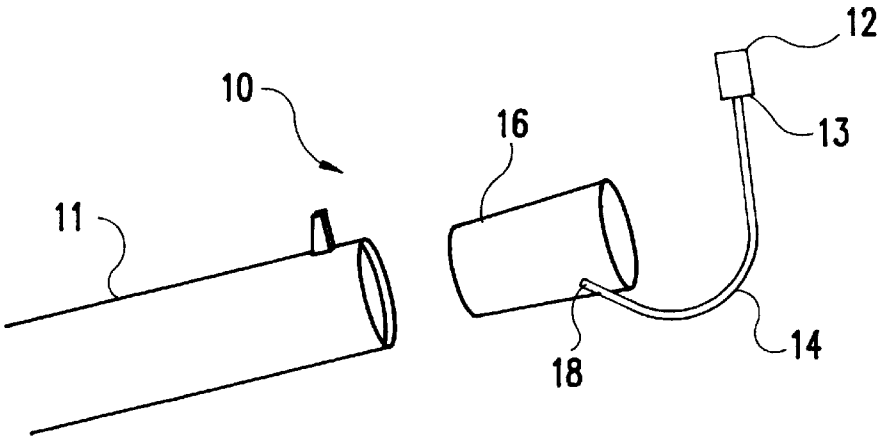
FIG. 1A is a perspective view of one embodiment of the lead demonstrator in accordance with the present invention.

The present invention is not limited to any particular type of shooting but, may be utilized with all types of guns and all types of stationary and non-stationary target shooting as described further below. Referring now to the drawings, and more particularly to FIG. 1A, there is shown an exemplary embodiment of the lead demonstrator device of the present invention.

Lead demonstrator 10 comprises a target representation means 12 coupled to one end of a connector 14 and an attachment means 16 connected to the other end of the connector 14. In this embodiment the attachment means 16 fits into the gun barrel. By looking down the barrel of the gun the shooter is able to accurately visualize what the target picture should look like.

The target representation means may take on a variety of forms depending upon the particular type of shooting. By way of example and not by limitation, FIGS. 2A–2F depict some target representations usable with the present invention. It is understood that many different target representations may be used in the practice of the invention.

Figure 2A:
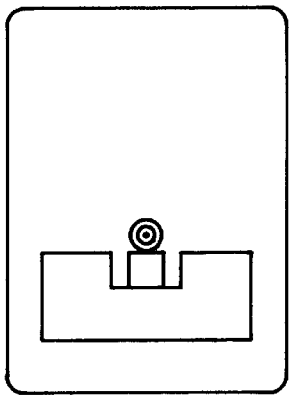
FIG. 2A–2F illustrate representative examples of target means usable with the present invention.

For example, FIG. 2A shows what a down range sight picture would look like when using a conventional Partridge sight for shooting at a typical bulls-eye target. What is important is that the represented target, no matter what it is, be of such a size so as to approximate the image that the shooter would see down range. The size of the target representation means 12 is proportional to the size of the actual target taking into consideration the typical distance from the target.

Of course, some deviation in the proportionality of the target representation means to actual target is expected in the practice of this invention owing to the many different target shooting distances. In general, however, the target representation means 12 of the present invention provides a more accurate image of a down range sight picture than the mere verbal exchange with an instructor or target representations based on oversized graphs and charts.

Figure 2B:
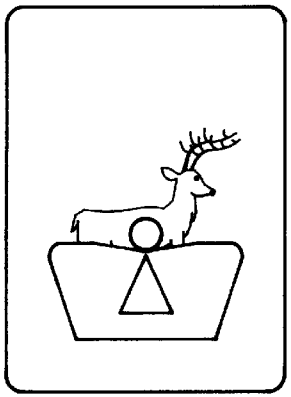
Figure 2C:
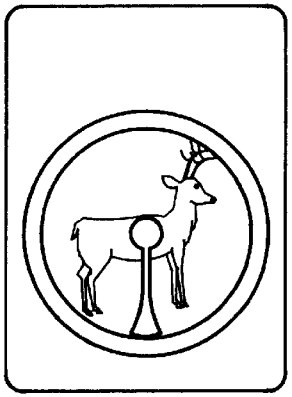
Figure 2D:
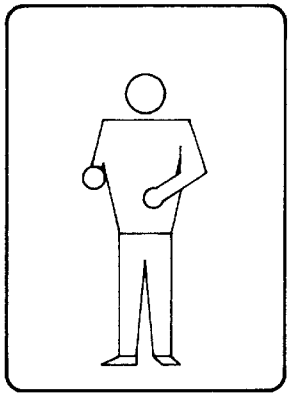

FIGS. 2B, 2C, and 2D illustrate other conventional targets that may be used, including the shallow-V, aperture, and human silhouette sight pictures.

Figure 2E:
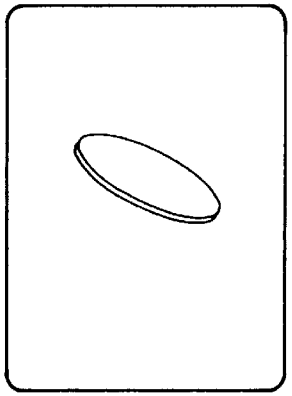

FIG. 2E is an example of a skeet or clay silhouette. As described more fully below, the skeet silhouette may be selectively positioned in the field of view of the shooter so as to approximate the lead image associated with shooting moving targets.

Figure 2F:
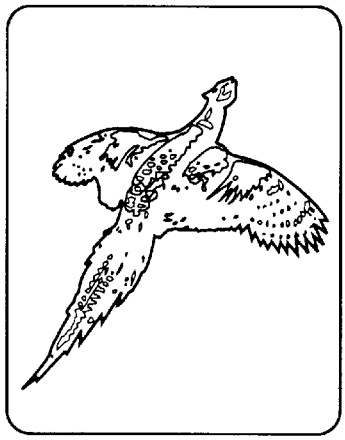

FIG. 2F is an example of a target representing the flying species, such as a duck or bird.

Each of the target representation means 12 may be selectively positioned in the field of view of the shooter. As described more fully below, this selective manipulation is especially important to approximate the lead image associated with shooting moving targets.

Referring again to FIG. 1A, the selective manipulation of the target representation means 12 is made possible by connecting means 14. One end of the connecting means is attached to the target representation means, and the other is attached to attachment means 16. The connecting means 14 preferably consists of a thin elongated flexible wire or other equivalent structure that allows the connecting means 14 to bend. The wire may be made of metal, plastic, or rubber.

By bending the connecting means 14 in various positions, the target representation means 12 may be selectively positioned to the desired location to enable visualization of the lead image. Since the lead image changes as the location of the shooter and the travel path of the skeet or clay change, the target representation means can be quickly oriented accordingly.

The target representation means 12 may be affixed to the connecting means 14 by any coupling method. By way of example and not by limitation, the coupling method used may be to construct or utilize a peel-on/peel-off target representation means 12.

Alternatively, the coupling method can be part of the target representation means 12 or connecting means 14. For example, the target representation means 12 can be composed of a dense foam of sufficient depth to merely stick on the end of the connecting means 14 to form the fastening means 13. It is understood that many different fastening means may be used in the practice of this invention.

The attachment means 16 in the embodiment of FIG. 1A is in the form of a truncated cone to facilitate insertion in or removal from gun barrel 11. The attachment means 16 may utilize other shapes so long as one end can be easily inserted and removed from the gun barrel 11 before firing. The attachment means 16 may be made from many different materials, including metals, plastics, rubber, wood, or cork.

Figure 3:
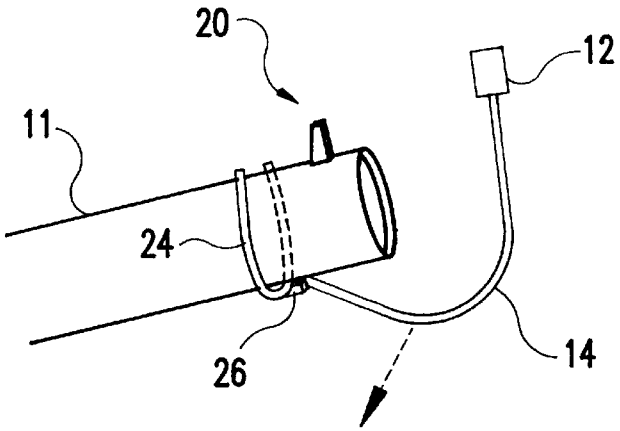
FIG. 3 is a perspective view of another embodiment of the lead demonstrator in accordance with the present invention.

The second end of the connecting means 14 is affixed to the attachment means 16 at connection point 18. This connection point 18 may be of any type so long as repeated manipulation of the connecting means 14 does not result in failure at the connection point 18. Screw connections, pin connections, and weld points are contemplated. Alternatively, the connecting means 14 may be successively wrapped around the attachment means 16 as shown in FIG. 1B. FIG. 3 illustrates an alternate, more permanent embodiment 20 of the attachment means of the present invention. Rather than an attachment means that fits in the gun barrel 11, the attachment means may comprise a U-clip 24 that attaches to the gun barrel 11. Different U-clips may be utilized, depending on whether the gun is a single barrel, a side-by-side double barrel, or an over-and-under double barrel.

Figure 4:
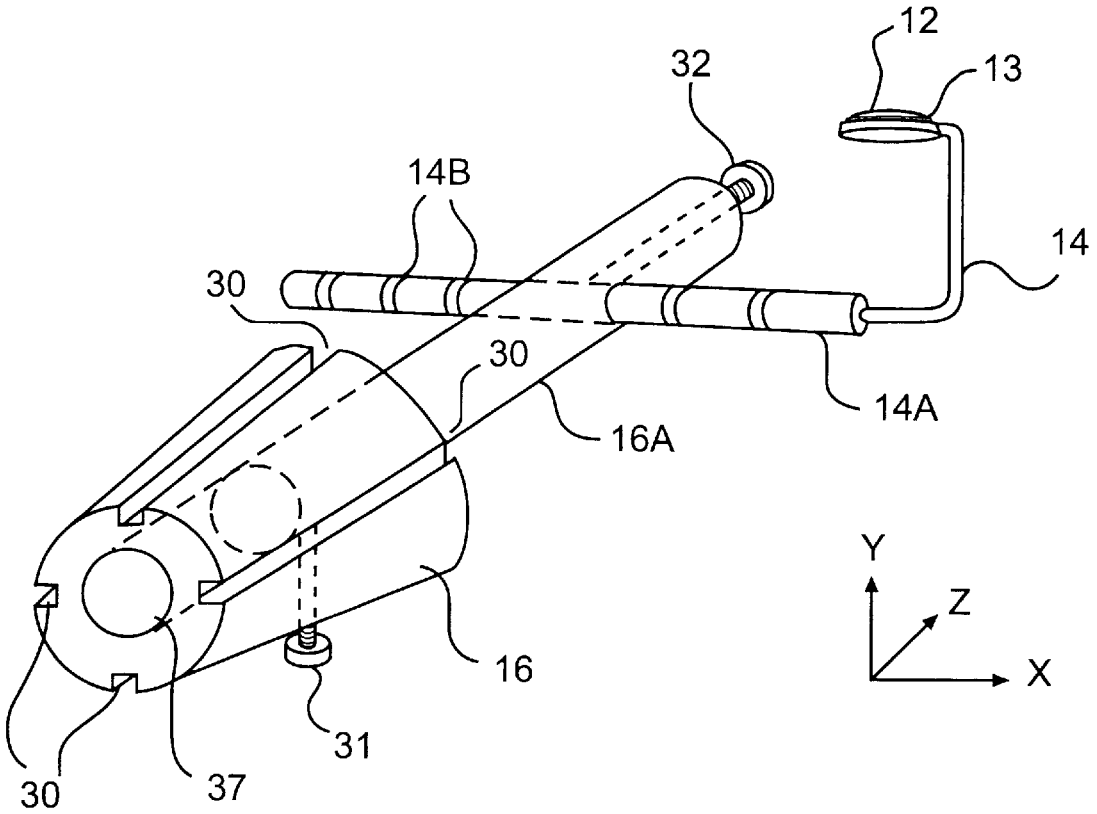
FIG. 4 is a perspective view of a further alternative embodiment of the lead demonstrator in accordance with the present invention.

FIG. 4 illustrates a still further embodiment of the present invention comprising alternate target representation means 12, connecting means 14, and attachment means 16. As shown in FIG. 4, the target representation means 12 is comprised of a skeet or clay silhouette as previously discussed with reference to FIG. 2E. It is understood that the target representation means may depict any of a multitude of targets, with FIGS. 2A–2F serving as representative targets. For example, the clay or skeet silhouette in FIG. 2E may be replaced by another target representing a flying species, such as a duck or bird as shown in FIG. 2F.

As described above, any of the target representation means 12 may be made of foam or a peel-on/peel-off target. The target representation means 12 may also be composed of plastic, wood, cork, rubber or metal.

In this embodiment, the coupling method is comprised of a pin connection whereby one end of the connecting means 14 is inserted into the target representation means 12 and secured either by glue, paste, or friction fit. Preferably the connecting means 14 is flexible but it need not be as described later in the specification. Moreover, the connecting means may be composed of a series of right angles as shown in FIG. 4, or the connecting means may take on a curved or U-shape.

As shown in FIG. 4, the second end of the connecting means 14 is comprised of a bar 14A having calibration markings 14B. The calibration markings 14B are spaced so as to correspond to the different leads required for the various skeet or trap positions. Alternatively, the calibration markings 14B may be left off the bar 14A.

The tapered conical attachment means 16 in this embodiment also includes an extension 16A having a transverse hole 34 therein. The extension 16A may be manufactured as an integral part of the tapered cone section 16, by using a mold, for example. Alternatively, the extension 16A may be manufactured separately and inserted into a hole 37, extending at least a portion of the way through the tapered cone section 16, or extending completely through the tapered cone section 16. In the event the extension 16A is manufactured separately, a first tightening means 31, such as a screw or other equivalent structure, is provided as shown in FIG. 4 to secure the extension 16A to the taped conical section.

By manipulating the first tightening means 31, once the lead demonstrator device is placed in the gun, it need not be repeatedly removed to align the target about the gun barrel, or z-axis in FIG. 4. In other words, the tightening means 31 may be selectively loosened to orient the lead demonstrator and then re-tightened once the proper alignment is achieved while the tapered conical section of the attachment means remains in the end of the gun barrel.

In this embodiment the attaching means is coupled to the second end of the connecting means by sliding the bar 14A into the hole 34. A second tightening means 32, for example a screw or other equivalent structure, serves to secure the bar 14A in its intended position. Alternatively, the bar 14A and the hole 34 may be machined sufficiently to ensure a friction fit but which will still allow movement of the bar when desired.

The transverse hole 34 allows the connecting means 14, and thus the target representation means 12, to be moved laterally in the x-direction as well as being able to rotate in the z-direction as shown in FIG. 4, even if the connecting means 14 is not comprised of a flexible, bendable material. In all cases, therefore, the target may be selectively positioned to approximate the down range target view.

As discussed above, the lead demonstrator of the present invention is meant to be a teaching aid. In practice, the device is first positioned at the end of the gun barrel, either by inserting the attaching means in the gun barrel as in FIGS. 1A, 1B, or 4, or by using the U-clip or latching means as shown in FIG. 3, to enable the shooter to visualize the down range image of the target. The lead demonstrator is then removed from the line of sight prior to firing. If the device is inadvertently left in the barrel while firing, however, a backfire mishap may occur, potentially causing injury. To reduce the risk associated with such an unlikely event, one or more blow-by grooves 30 may be provided in the tapered attachment means 16 to ensure that the device would be ejected when firing the weapon.

The connecting means 14 and target representation means 12 are the same as described with respect to the embodiment shown in FIG. 1A. The U-clip may be merely twisted so the target representation means 12 is out of the line of fire prior to shooting.

A further enhancement to attachment means 24 would incorporate a hinge and latching means 26 at the base of U-clip 24 so that the target representation means 12 may be taken out of the line of fire prior to shooting by flipping down the hinge and latching means 26. The hinge and latching means 26 may be any conventional means.

The unique advantage of this invention is the combination of the target representation means 12 with a flexible connecting means 14. This allows both lead and target alignment to be accurately illustrated by an instructor prior to actual shooting. This visual image establishes a baseline from which the student and instructor can later base corrections. Use of the invention will result in enhanced understanding of lead and target alignment, leading to better and more accurate shooting, and ultimately more enjoyment.

Figure 5:
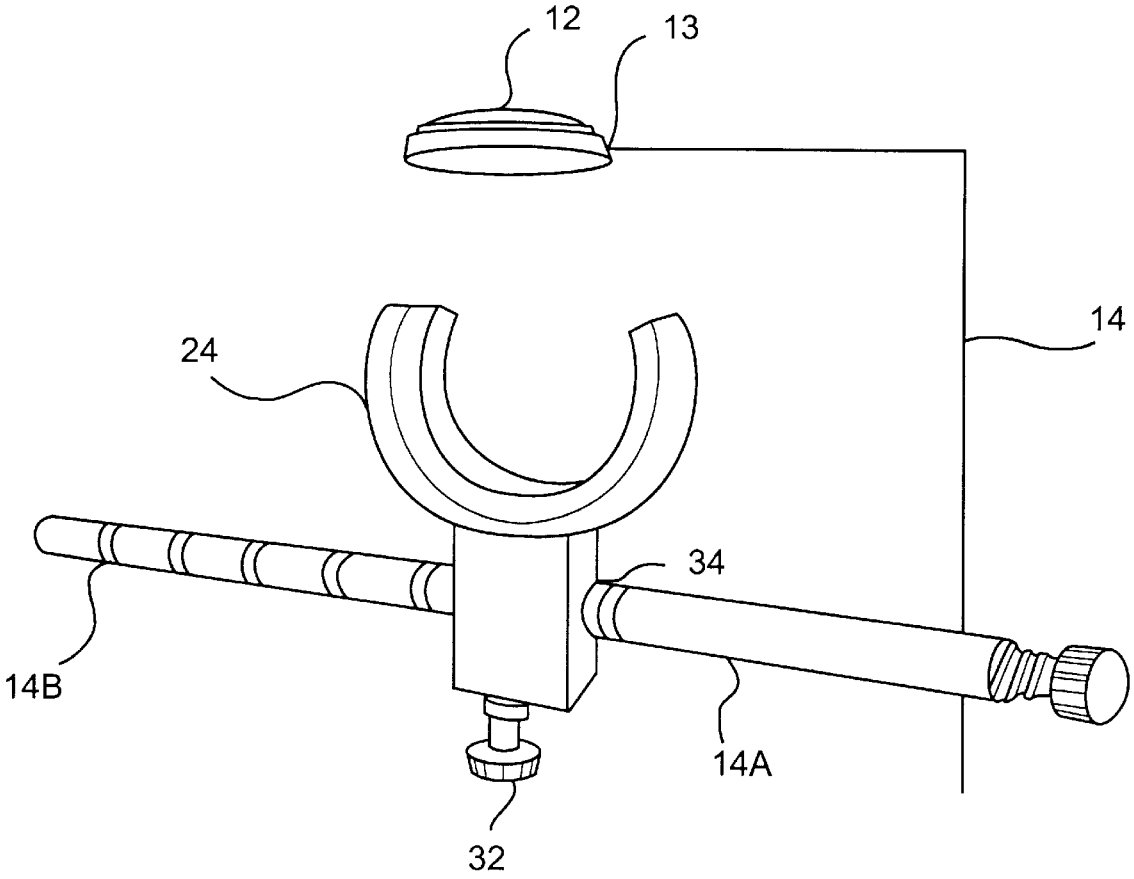
FIG. 5 is a perspective view of a further alternative embodiment of the lead demonstrator in accordance with the present invention.

FIG. 5 illustrates an embodiment combining the features of FIGS. 3 and 4. Specifically, FIG. 5 depicts the U-clip 24 attachment means as shown in FIG. 3 with the calibration bar 14A, having calibration markings 14B, as shown in FIG. 4. Like reference numerals refer to the same or like parts. A set screw 33 serves to attach flexible connecting means 14 to the bar 14A and to permit adjustment of the target representation means in at least one plane.

While the invention has been described in terms of the embodiments described above, those skilled in the art will recognize that the invention can be practiced with modification within the spirit and scope of the appended claims.

Having thus described my invention, what I claim as new and desire to secure by Letters Patent is as follows:

1. A target and shooting aid, comprising:

a connecting means having first and second portions, said first portion including a set means adapted to reversibly couple a target representation means to said connecting means, said connecting means including a solid or hollow bar member;

an attaching means coupled to said second portion of said connecting means, said attaching means comprising a rounded structure being adapted for reversible attachment to an external surface of a dischargable weapon, or simulated weapon, wherein said attaching means does not wrap entirely around said external surface of said dischargeable weapon or simulated weapon, and wherein said attaching means comprises a transverse hole for communicating with said bar member and a means for reversibly fixing the position of said bar member; wherein (i) said bar member is adapted to permit adjustment of said target representation means in at least two planes; and (ii) said set means is adapted to communicate with said bar member in such a manner as to permit attachment of said bar member to said target representation means, and to permit adjustment of said target representation means in at least one plane;

wherein said aid is adapted to permit movement of said target representation means in three planes.

2. The target and shooting aid according to claim 1, wherein said bar member further comprises calibration markings and said means for reversibly fixing the position of said bar member is a screw member means.

3. The target and shooting aid according to claim 2, further comprising a target representation means.

4. A target and shooting aid, comprising:

connecting means having first and second ends, wherein said first end may be reversibly coupled to a target representation means, and wherein at least a portion of said connecting means is flexible such that it can be reversibly shaped to permit movement of said target representation means means in three planes; and attaching means, coupled to said second end of said connecting means, said attaching means being adapted for reversible attachment to an external surface of a dischargeable weapon, or simulated weapon, or to an internal surface of the barrel of a weapon or a simulated weapon wherein the attaching means has an inverted truncated cone shape.

5. The shooting aid of claim 4, wherein the truncated cone contains grooves.

* * * * *